US010016772B2

(12) United States Patent
Bapat et al.

(10) Patent No.: US 10,016,772 B2
(45) Date of Patent: Jul. 10, 2018

(54) SPRAY BOTTLE ASSEMBLY

(71) Applicants: EID PARRY (INDIA) LIMITED, Chennai (IN); INDIAN INSTITUTE OF TECHNOLOGY, BOMBAY, Mumbai (IN)

(72) Inventors: Vijay P. Bapat, Mumbai (IN); Purba Joshi, Mumbai (IN); Narasimha Rao Kothapalli, Irving, TX (US); M. Sathiyamurthy, Chennai (IN); R. Radha Krishnan, Cuddalore (IN); S. Balaji, Chennai (IN); L. K. Baburaj, Chennai (IN)

(73) Assignees: EID PARRY (INDIA) LIMITED (IN); INDIA INSTITUTE OF TECHNOLOGY, BOMBAY (IN)

( * ) Notice: Subject to any disclaimer, the term of this patent is extended or adjusted under 35 U.S.C. 154(b) by 0 days.

(21) Appl. No.: 15/053,240

(22) Filed: Feb. 25, 2016

(65) Prior Publication Data

US 2017/0088334 A1 Mar. 30, 2017

(30) Foreign Application Priority Data

Sep. 30, 2015 (IN) ..... 5228/CHE/2015

(51) Int. Cl.

| | |
|---|---|
| ***B67D 7/70*** | (2010.01) |
| ***B05B 11/00*** | (2006.01) |
| ***B05B 11/02*** | (2006.01) |

(52) U.S. Cl.

CPC ..... *B05B 11/3014* (2013.01); *B05B 11/0054* (2013.01); *B05B 11/02* (2013.01)

(58) Field of Classification Search

CPC ..... B05B 11/067; B05B 11/0097; B05B 11/0054; B05B 11/0056; B05B 11/3014; B05B 11/02; B65D 83/3216

USPC ..... 222/135, 145.5, 383.1, 383.3, 391; 206/219

See application file for complete search history.

(56) References Cited

U.S. PATENT DOCUMENTS

| | | | | |
|---|---|---|---|---|
| 4,832,230 | A * | 5/1989 | Janowitz | B05B 11/0037 222/136 |
| 5,439,141 | A | 8/1995 | Clark et al. | |
| 6,182,865 | B1 * | 2/2001 | Bunschoten | B05B 11/0078 222/136 |
| 6,997,351 | B2 * | 2/2006 | Cho | B05B 11/0081 206/222 |
| 2009/0289025 | A1 * | 11/2009 | Mueller | B05B 11/0081 215/44 |

* cited by examiner

*Primary Examiner* — Lien Ngo
(74) *Attorney, Agent, or Firm* — Barnes & Thornburg LLP

(57) ABSTRACT

The present disclosure includes a spray bottle assembly (100) which provides separate compartments for containing two or more constituents of a formulation, thereby, preventing premixing of the constituents before the first use, hence, increasing shelf life in a hassle-free way. The spray bottle assembly (100) comprises a spray head (200) for discharging the constituents of a formulation stored in the spray bottle assembly (100), a container bottle (300) for storing a passive constituent of the formulation; a storage receptacle (400) coupled with the container bottle (300), wherein said storage receptacle (400) facilitates the storage of an active constituent of the formulation isolated from the passive constituent; and a dispensing means (500) integrated with the storage receptacle (400).

5 Claims, 5 Drawing Sheets

SPRAY BOTTLE ASSEMBLY

FIELD OF THE INVENTION

The present disclosure relates to spray bottle assemblies and more particularly to a spray bottle assembly for packaging and mixing of various formulations without premixing the constituents of said formulations.

BACKGROUND OF THE INVENTION

There are numerous hand held discharging assemblies known in the prior art designed to deliver a single liquid solution such as a solution of water and some cleansing agent. Bottlers of chemical reagents typically market their products by purchasing separately empty plastic container bottles and spray heads. The bottlers then fill, assemble, and label the completed discharging assembly packages for delivery to retailers. Consumers purchase filled discharging assembly at the point-of sale, and then utilize the constituents of said discharging assembly.

SUMMARY OF THE INVENTION

The present application discloses one or more of the features recited in the appended claims and/or the following features which, alone or in combination, may comprise patentable subject matter.

According to one aspect of the present disclosure, a spray bottle assembly may include a means for discharging constituents of a formulation stored in the spray bottle assembly, a container bottle coupled with means for discharging the constituents, said storage container bottle facilitates storage of a passive constituent of the formulation, a storage receptacle coupled with the container bottle, said storage receptacle facilitates storage of an active constituent of the formulation isolated from the passive constituent, and a dispensing means integrated with the storage receptacle, said spray bottle assembly preventing premixing of the active and the passive constituents of the formulation stored in the spray bottle assembly.

In some embodiments, the means for discharging the constituents is a spray head, the spray head further includes a spray nozzle, a trigger mechanism and a tube extending to the bottom of the container bottle to draw constituents of the formulation stored in the container bottle with the trigger mechanism.

In some embodiments, the container bottle may include a neck portion, wherein a topside of the neck portion couples with the spray head, a reservoir extending from an underside of the neck portion, said reservoir facilitates storage of passive constituents of the formulation, and a means for attaching the storage receptacle.

In some embodiments, the means for attaching the storage receptacle may be a cavity, and said cavity extends from the exterior surface of the reservoir and facilitates coupling of the storage receptacle with the container bottle.

In some embodiments, the storage receptacle may include a housing, a means for coupling the storage receptacle with the cavity of the container bottle, a hollow channel within the housing for inserting a dispensing means, and a chamber beneath the hollow channel, wherein said chamber opens into the container bottle.

In some embodiments, the chamber beneath the hollow channel is demarcated by a thin sheath of metal, plastic or any other suitable material. The chamber holds active constituents of the formulation.

In some embodiments, the dispensing means may be inserted into the hollow channel of the storage receptacle, and said dispensing means may be used for dispensing the active constituents stored in the chamber into the storage reservoir to facilitate mixing of the active and the passive constituents at the time of first use.

In some embodiments, the dispensing means may be provided with a locking mechanism to prevent accidental mixing of the active and the passive constituents of the formulation stored in the spray bottle assembly.

In some embodiments, the container bottle may be fabricated from any suitable material selected from a group consisting of polymeric materials such as thermoplastics, rubber, thermosets; glass; metals or any other suitable material.

In some embodiments, the storage receptacle may be fabricated from any suitable material selected from a group consisting of polymeric materials such as thermoplastics, rubber, thermosets; glass; metals or any other suitable material.

In another aspect of the present disclosure there is provided a method for making a spray bottle assembly comprising: providing a means for discharging constituents of a formulation stored in the spray bottle assembly, forming a container bottle coupled with means for discharging, said container bottle facilitates storage of a passive constituent of the formulation, said container bottle is further coupled with a storage receptacle; said storage receptacle stores at least one active constituent of the formulation isolated from the passive constituent, thereby preventing premixing of the active and the passive constituents of the formulation stored in the spray bottle assembly, and providing a dispensing means to be integrated with the storage receptacle.

In some embodiments the step of forming the container bottle comprises providing a neck portion, wherein a topside of the neck portion couples with the means for discharging constituents of the formulation of the spray bottle assembly, forming a reservoir extending from an underside of the neck portion, said reservoir facilitates storage of the passive constituents of the formulation, and providing a means for attaching the storage receptacle.

In some embodiments, the means for attaching the storage receptacle may be a cavity, and said cavity extends from the exterior surface of the reservoir and facilitates coupling of the storage receptacle with the container bottle.

In some embodiments, the step of forming the storage receptacle may include: providing a housing, providing a means for coupling the storage receptacle with the cavity of the container bottle, providing a hollow channel within the housing for inserting the dispensing means, and providing a chamber beneath the hollow channel, wherein said chamber opens into the container bottle.

In some embodiments, the chamber beneath the hollow channel is demarcated by a thin sheath of metal, plastic or any other suitable material. The chamber holds the active constituent of the formulation stored in the spray bottle assembly.

In some embodiments the step of integrating the dispensing means with the storage receptacle includes inserting the dispensing means into the hollow channel of the storage receptacle, and said dispensing means may be used for dispensing the active constituents stored in the chamber into the storage reservoir to facilitate mixing of the active and the passive constituents at the time of first use.

In some embodiments, the dispensing means may be provided with a locking mechanism to prevent accidental mixing of the active and the passive constituents of the formulation stored in the spray bottle assembly.

In some embodiments, the active material may be selected from a group consisting of pesticides, herbicides, other crop protectants, fertilizers, crop nutrients of chemical or biological/natural origin, biopesticides, bioherbicides, biofertilizers, cleaning composition etc. and passive material may be selected from a group comprising water, solvent, diluent, carrier or any other form of passive material etc.

In some embodiments, the spray bottle assembly may comprises plurality of storage receptacles.

Other aspects, advantages, and salient features of the present disclosure will become apparent to those skilled in the art from the following detailed description read in conjunction with the drawings.

BRIEF DESCRIPTION OF THE DRAWINGS

The following drawings are illustrative of embodiments enabling the present disclosure, are descriptive of some methods, and are not intended to limit the scope of the present disclosure. The drawings are not to scale (unless so stated) and are intended for use in conjunction with the explanations in the following detailed description.

DETAILED DESCRIPTION OF THE INVENTION

Figure 1:
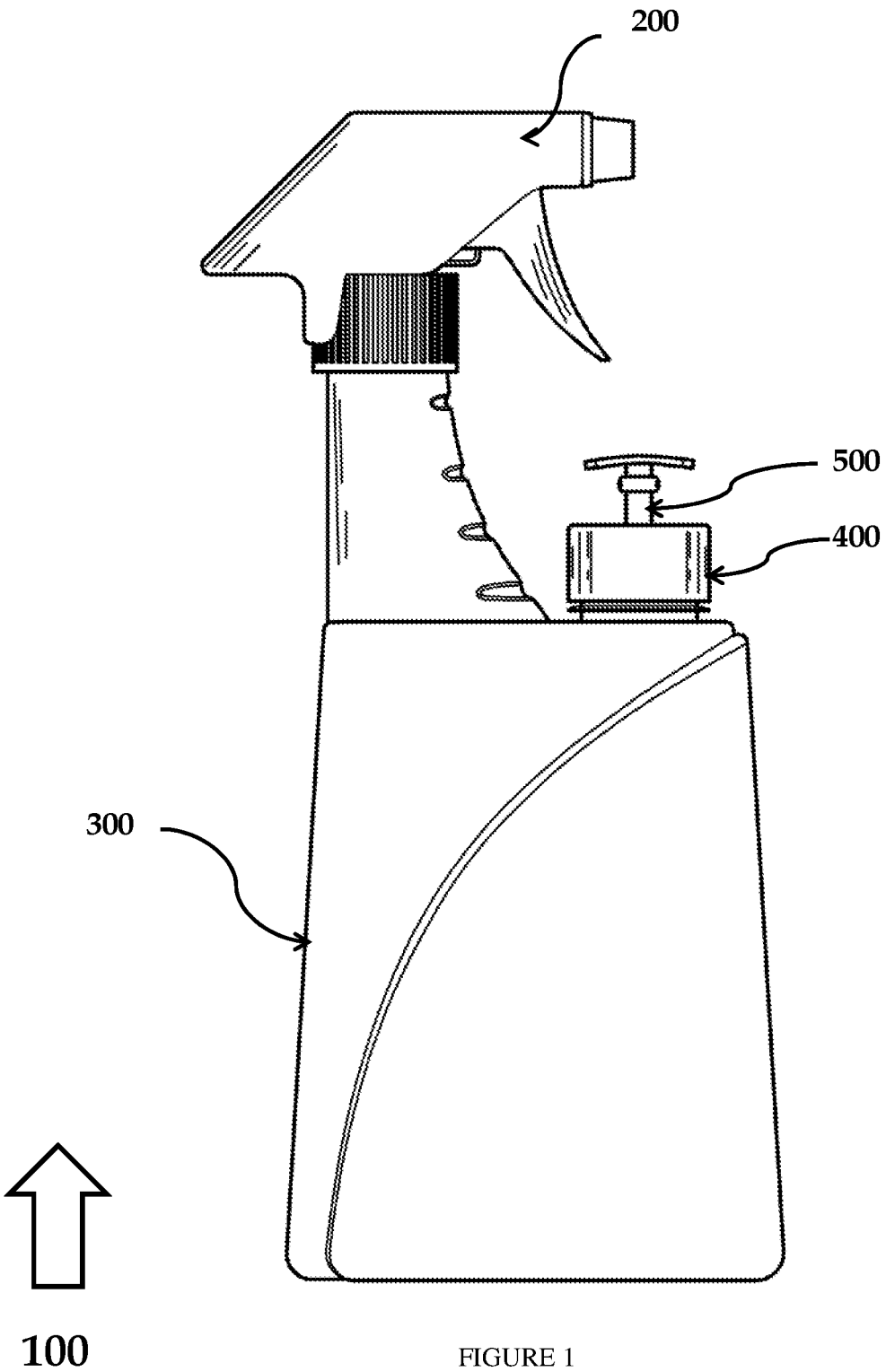
FIG. 1: shows a front view of the spray bottle assembly in accordance with an illustrative embodiment.

Illustrative embodiments of the present disclosure will be described hereinafter in reference to the accompanying drawings.

It is to be noted that, as used in the specification and the appended claims, the singular forms "a", "an" and "the" include plural referents unless the context clearly dictates otherwise. It should also be noted that the term "or" is generally employed in its sense including "and/or", unless the content clearly dictates otherwise. It should also be noted that by the term "substantially" it is meant that the recited characteristic, parameter, or value need not be achieved exactly, but that deviations or variations, including for example, tolerances, measurement error, measurement accuracy limitations and other factors known to those skilled in the art, may occur in amounts that do not preclude the effect the characteristic was intended to provide.

The conventional spray bottles as described earlier in the specification encounter several problems during filling and packaging with active constituents, for example: pesticide, herbicides, other crop protectants, fertilizers, crop nutrients of chemical or biological/natural origin, biopesticides, bioherbicides, biofertilizers, cleaning composition or other active products because most of the aforesaid active constituents included in the packaged formulation are not chemically stable for long periods of time once they are mixed with the passive constituent wherein passive material may be selected from a group comprising water, solvent, diluent, carrier or any other form of passive material etc., and therefore experience a comparatively short shelf life.

To overcome the aforementioned problem, spray bottles which prevent the intermixing of components filled therewithin the bottle were developed in the art. One such attempt has been disclosed in U.S. Pat. No. 5,439,141 entitled "Dual liquid spraying systems". Said patent discloses a manifold for use with a hand held pump spray device allowing the spray head to draw simultaneously from two separate reservoirs containing two different liquids such that the spray head raises a mixture of the two liquids in a predetermined ratio. The manifold includes at least one ball check valve arrangement in the suction line to the chemical concentrate reservoir, the ball check valve being normally biased to a closed position. The check valve presents the pumping of the concentrate when the diluent reservoir is spent and further prevents cross contamination between the liquids in the two reservoirs due to syphoning.

The spray mechanism as described in the aforementioned patent, however, does not provide efficient mixing of the contents of the bottle, as the two liquids are drawn simultaneously from two separate reservoirs and therefore the mixing time is extremely short. Also, said spray bottles are relatively complicated, hence many small parts have to be handled and assembled with care during manufacture. In fact, the spray mechanisms of these bottles often cost more than the product contained within the bottle.

Thus, there is a need for a spray bottle assembly which is easy to manufacture and can be effectively packed, stored, and shipped with various formulations, such as pesticides, herbicides, other crop protectants, fertilizers, crop nutrients of chemical or biological/natural origin, cleaning composition and other active products and overcome the problem of short shelf life and efficacy.

An illustrative spray bottle assembly of the present disclosure provides separate compartments for containing two or more constituents of a formulation, thereby, preventing premixing of the constituents before the first use, hence, increasing shelf life in a hassle-free way. The term "container bottle" as used in the specification refers to a means for accommodating a constituent of a formulation being stored in the spray bottle assembly, wherein said container bottle may be of any geometric or non-geometric shape. The term "storage receptacle" as used in the specification refers to a hollow object used to contain a constituent of a formulation. The term "cavity" as used in the specification refers to a hole on the surface of the container bottle enclosed by walls.

Referring to FIG. 1 a front view of the spray bottle assembly in accordance with an illustrative embodiment of the present disclosure is shown. The spray bottle assembly (100) comprises a means for discharging such as spray head (200) for discharging constituents of a formulation stored in the spray bottle assembly (100); a container bottle (300) for storing a passive constituent of the formulation; whereon the spray head (200) is attached; a storage receptacle (400) is attached with the container bottle (300) such that a distal end of the storage receptacle (400) opens into the container bottle (300), said receptacle (400) facilitates the storage of active constituents of the formulation isolated from the passive constituents in the form of a gel, a capsule, other form of encapsulated material and the like; and a dispensing means (500) inserted into the storage receptacle (400). The storage receptacle (400) may be permanently fixed or detachably fixed with the container bottle (300). The spray bottle assembly (100) can be of any size and can be fabricated in any geometric and non-geometric shape such as cylindrical, rectangular, pyramidal etc. from any suitable material selected from a group consisting of polymeric materials such as thermoplastics, rubber, thermosets; glass; metals or any other suitable material to accommodate constituents of the formulation.

Figure 2:
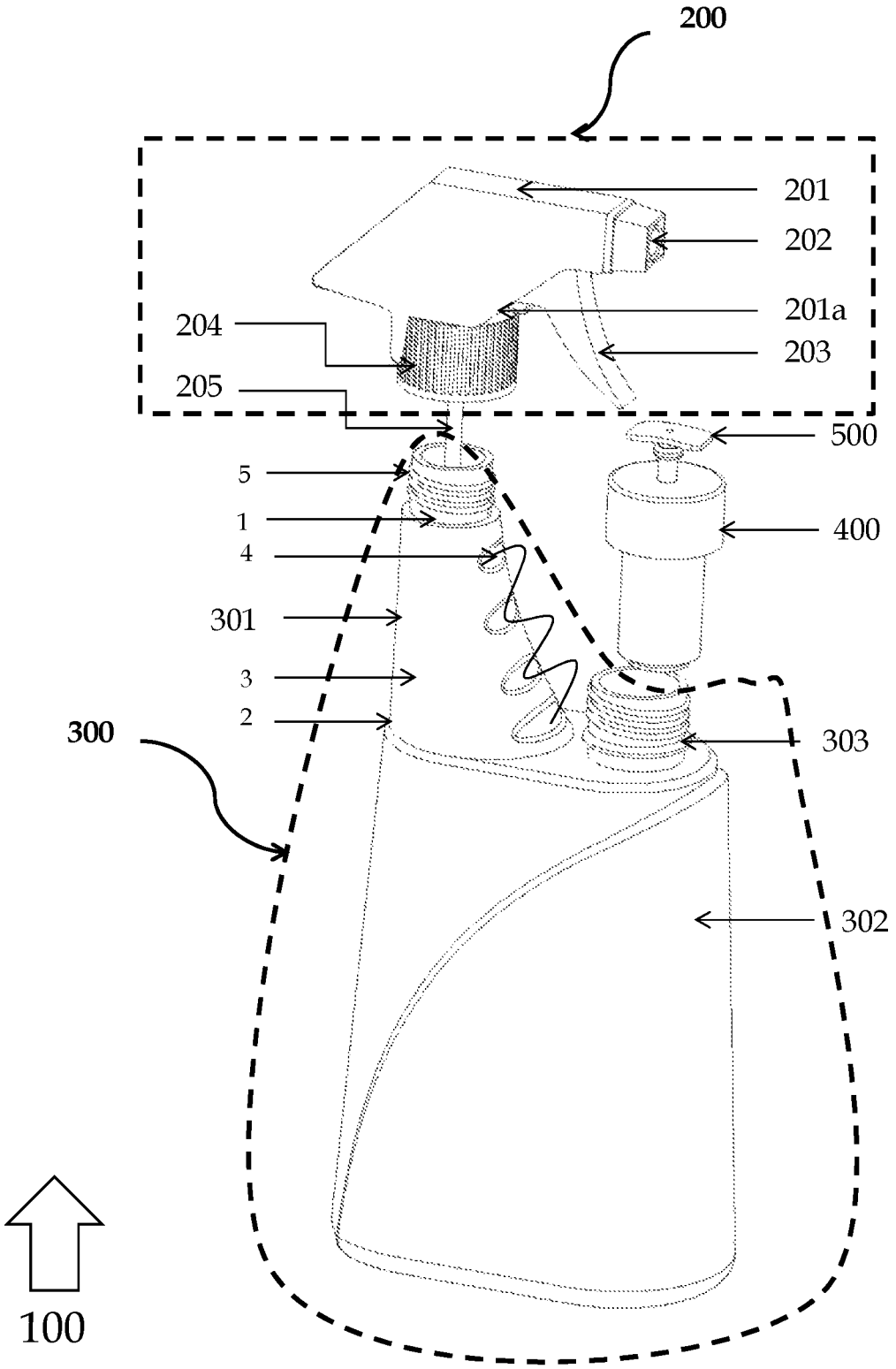
FIG. 2: shows an exploded view of the spray bottle assembly in accordance with the the illustrative embodiment.

Referring to FIG. 2 an exploded view of the spray bottle assembly in accordance with the illustrative embodiment of the present disclosure is shown. The spray head (200) and the storage receptacle (400) couples with the container bottle (300) and the dispensing means (500) is inserted into the storage receptacle (400).

The spray head (200) can be any known means for discharging constituents of the formulation stored in the spray bottle assembly (100), said spray head (200) may include a nozzle and a mechanism to draw the constituents of the formulation from the container bottle (300). The spray head (200) can be selected from a group consisting of trigger actuated spray head, pump actuated spray head or any other known spray head. In the illustrative embodiment a trigger actuated spray head is being used. The spray head (200) includes a housing (201); a spray nozzle (202) attached to the housing (201), a trigger (203) pivotally connected to the proximal end (201*a*) of the housing (201), a collar (204) extending from the underside of the housing (201) which includes a plurality of substantially radially inwardly projecting rims which allows the spray head (200) to be coupled with the container bottle (300) and a tube (205) extending to the bottom of the container bottle (300) to draw the contents of the bottle upto the spray nozzle (202) with a trigger mechanism, wherein the inlet of the trigger mechanism is connected to the tube (205) and the outlet of the trigger mechanism is connected to the spray nozzle (202).

The container bottle (300) can be fabricated in a suitable shape selected from a group of geometric and non-geometric shapes such as rectangular, cylindrical, neem leaf type shape, triangular, pyramidal, wedge shape or any other suitable shape. The container bottle can be of any suitable size. The container bottle (300) may be fabricated from any suitable material selected from a group consisting of polymeric materials such as thermoplastics, thermosets, rubber; glass; metals or any other suitable material. The container bottle (300) may be fabricated in the form of a pouch, a bottle, a flask or any other suitable form as required by a person skilled in the art, further comprising means for attaching the spray head (200) and the storage receptacle (400) therewith. In some embodiments the means for attaching the spray head (200) may be a slot wherein the spray head (200) can be snap fitted, similar slot can be provided for attaching the storage receptacle (400). In some embodiments the means for attaching may be a cylindrical neck with helical threads whereon the spray head (200) and the storage receptacle (400) may be rotated and attached, provided the spray head (200) and the storage receptacle (400) also have complementary means for being coupled with the container bottle (300). The container bottle (300) may be suitable to accommodate liquids, powders, particulates, solids, gases, and other like substances.

In the illustrative embodiment as illustrated in FIG. 2 the container bottle (300) comprises a neck portion (301), a reservoir (302) and a cavity (303). The neck portion (301) is substantially of the shape of a wedge with a circular topside (1) with smaller diameter, an underside (2) with larger diameter and a side wall (3) extending laterally and contiguously around the topside (1) and the underside (2). A grip (4) is provided on the side wall (3) of the neck portion (301) enhancing comfort in handling the container bottle (300). The topside (1) of the neck portion (301) comprises a flange (5) extending vertically upwards to a suitable height, said flange (5) facilitating the coupling of spray head (200) with the container bottle (300). The collar (204) of the spray head (200) is rotated around the flange (5) to lock the spray head (200) with the container bottle (300).

The reservoir (302) extends downwards from the underside (2) of the neck portion (301), wherein said reservoir (302) facilitates the storage of passive ingredients of the formulation. On the exterior surface of the storage reservoir (302) adjacent to the neck portion (301) is fabricated a cavity (303), wherein said cavity (303) extends vertically upwards from the surface of the storage reservoir (302) and facilitates the coupling of the storage receptacle (400) with the container bottle (300).

Figure 3:
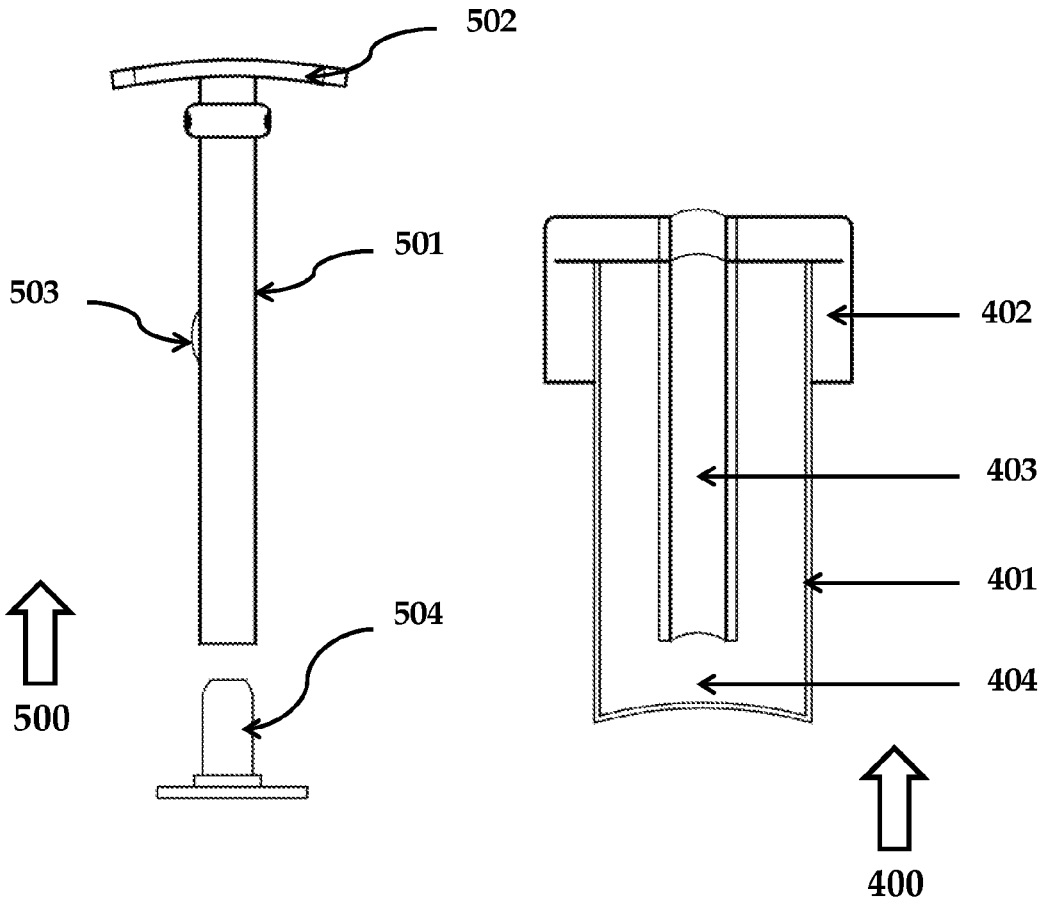
FIG. 3: shows an exploded sectional view of the storage receptacle and the dispensing means in accordance with the illustrative embodiment.

Referring to FIG. 3 an exploded sectional view of the storage receptacle and the dispensing means in accordance with the illustrative embodiment of the present disclosure is shown. The storage receptacle (400) may be fabricated from any suitable material selected from a group consisting of polymeric material such as thermoplastics, thermosets, rubber; glass metals; any other suitable material. The storage receptacle (400) may be suitable to accommodate liquids, powders, particulates, solids, gases, and other like substances.

In the illustrative embodiment the storage receptacle (400) comprises a cylindrical housing (401) of a diameter lesser than the diameter of the cavity (303) of the container bottle (300) such that some portion of the housing (401) may be accommodated into the container bottle (300); a hollow knob (402) enclosing a suitable height of the housing (401) from the topside, a hollow channel (403) therewithin the housing (401) and a chamber (404). The hollow knob (402) comprises a plurality of helical ridges (not shown) projecting towards the inner side; said ridges facilitates rotation of the hollow knob (402) round the cavity (303) of the container bottle (300) to attach the storage receptacle (400) with the container bottle (300). The hollow channel (403) extends from the topside of the housing (401) to a certain distance towards the underside of said housing (401), wherein the chamber (404) is fabricated. The hollow channel (403) may be a cylindrical bore, a groove or any other suitable means. A dispensing means (500) is provided to be inserted into the storage receptacle (400). The chamber (404) is demarcated by a thin sheath of metal or other material, wherein chamber (404) holds the active constituent of the formulation. The active ingredients may be stored in the chamber in form of a capsule, gel, pouch, other form of encapsulated packaging and the like.

The dispensing means (500) can be selected from a group consisting of screws, thin rods, or other suitable structure which can be inserted into the hollow channel (403). The dispensing means (500) is inserted into the hollow channel (403) of the storage receptacle (400) such that pressing the dispensing means (500) causes the active constituents to be introduced into the reservoir (302) to facilitate mixing of the active and the passive constituents at the time of first use.

In the illustrative embodiment, the dispensing means (500) includes a hollow cylindrical housing (501) further comprising, a substantially rectangular head (502) at the top side, a locking mechanism (503) on the outer surface of the hollow cylindrical housing (501) and a detachable protrusion (504) that fits into the hollow cylindrical housing (501). To integrate the dispensing means (500) with the storage receptacle (400), the hollow cylindrical housing (501) is inserted into the hollow channel (403) of the storage receptacle (400), wherefrom the detachable protrusion (504) is inserted into the cylindrical housing (501) from the underside. The rectangular head (502) acts as a means for pressing the dispensing means (500) and the detachable protrusion (504) facilitates dispensing of actives stored in the chamber (404). The locking mechanism (503) is an outgrowth on the outer surface of said housing (501) that locks the dispensing means (500) at a fixed position when inserted into the storage receptacle (400). The locking mechanism prevents the accidental mixing of the passive constituents of the container bottle (300) and the active constituents of the storage receptacle (400).

The storage receptacle (400) of the present disclosure may also be integrated with any discharging assembly known in the art. The discharging assembly may be selected from a group consisting of liquid spray dispensers, gas dispensers, bottles, fluid containers and the like. In order to practice the present disclosure, the storage receptacle (400) may be coupled with the discharging assembly such that a distal end of the storage receptacle opens into the discharging assembly. The discharging assembly stores a passive constituent of a formulation and the storage receptacle stores an active constituent of the formulation isolated from the passive constituent, thereby preventing premixing of the active and the passive constituents. In an alternate embodiment (not shown), the storage receptacle (400) may include a housing, a means for coupling the storage receptacle with the discharging assembly, a mechanism for dispensing the active constituent of the formulation into the discharging assembly, and a chamber to accommodate the active constituent of the formulation, wherein said chamber opens into the discharging assembly. The chamber and the mechanism for dispensing may be engageable with each other. The mechanism for dispensing the active constituent may be a thumb push mechanism or any other suitable mechanism, whereby the active constituents of the formulation are dispensed into the discharging assembly.

The storage receptacle (400) can be of any size and may be fabricated in any suitable geometric or non-geometric shape such as cylindrical, rectangular etc. as required by the person skilled in the art to accommodate the active constituents of the formulation. The storage receptacle (400) may include a housing, a means for coupling the storage receptacle (400) with the container bottle (300), a mechanism for dispensing the active constituents into container bottle (300) and a chamber (404) for accommodating the active constituent of the formulation. The means for coupling the storage receptacle (400) may be selected from a group consisting of knobs; male, female coupling, snap fit mechanism or any other suitable coupling structure. In some embodiments the storage receptacle may also be formed as an integral part of the container bottle (300), comprising a mechanism for dispensing the active constituents into container bottle (300) and a chamber for accommodating the active constituent of the formulation. In the illustrative embodiment the storage receptacle (400) comprises a cylindrical housing; a hollow knob enclosing the upper section of the housing, a hollow channel therewithin the housing and a chamber. The chamber is fabricated just below the hollow channel, wherein said chamber opens into the container bottle (300). The chamber is demarcated by a thin sheath of metal, plastic or any other suitable material, wherein chamber holds the active constituent of the formulation stored in the spray bottle assembly (100). The storage receptacle (400) has been explained in more detail later in the specification.

Figure 4:
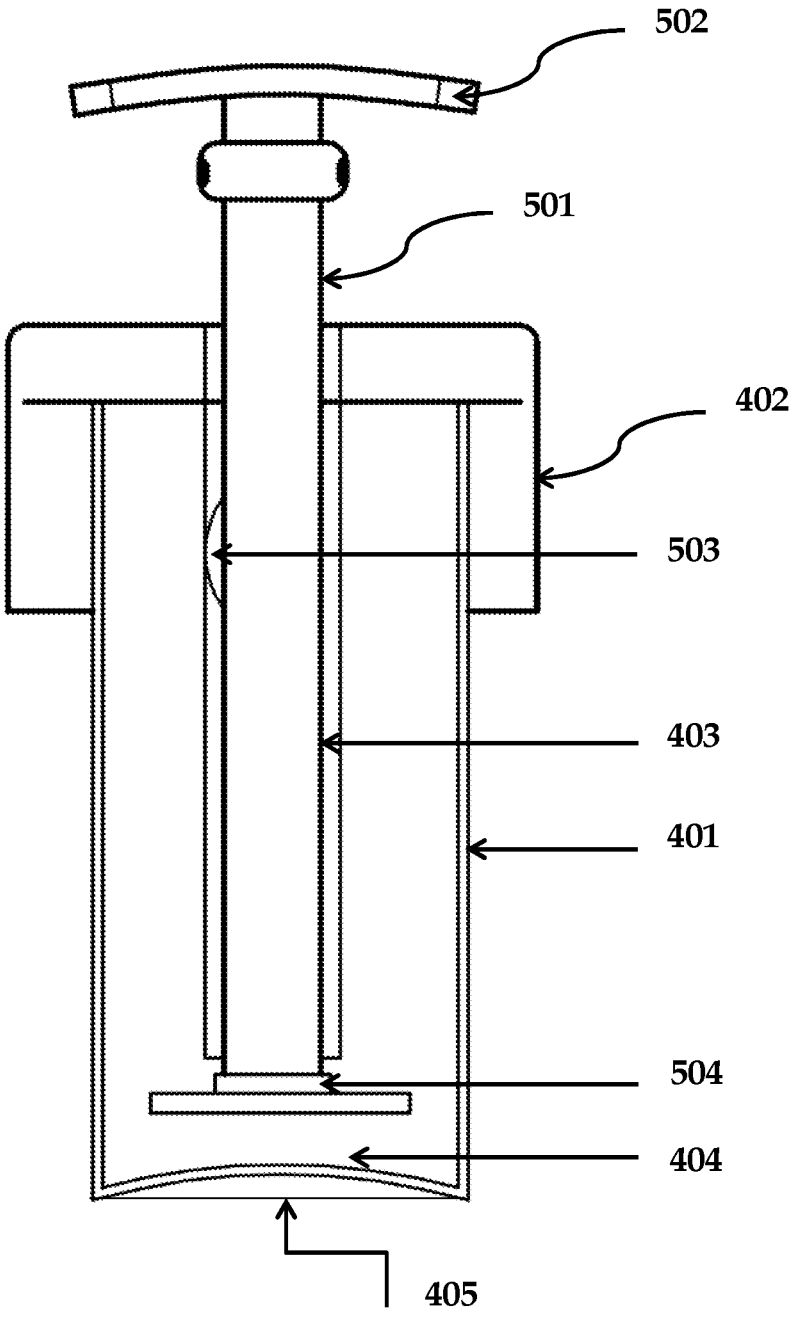
FIG. 4: shows a sectional view of the dispensing means inserted into the storage receptacle in accordance with the the illustrative embodiment.

Referring to FIG. 4 a sectional view of the dispensing means inserted into the storage receptacle in accordance with the illustrative embodiment of the disclosure is shown. As shown in the figure the locking mechanism (503) locks the dispensing means (500) at a fixed position when inserted into the storage receptacle (400).

Figure 5:
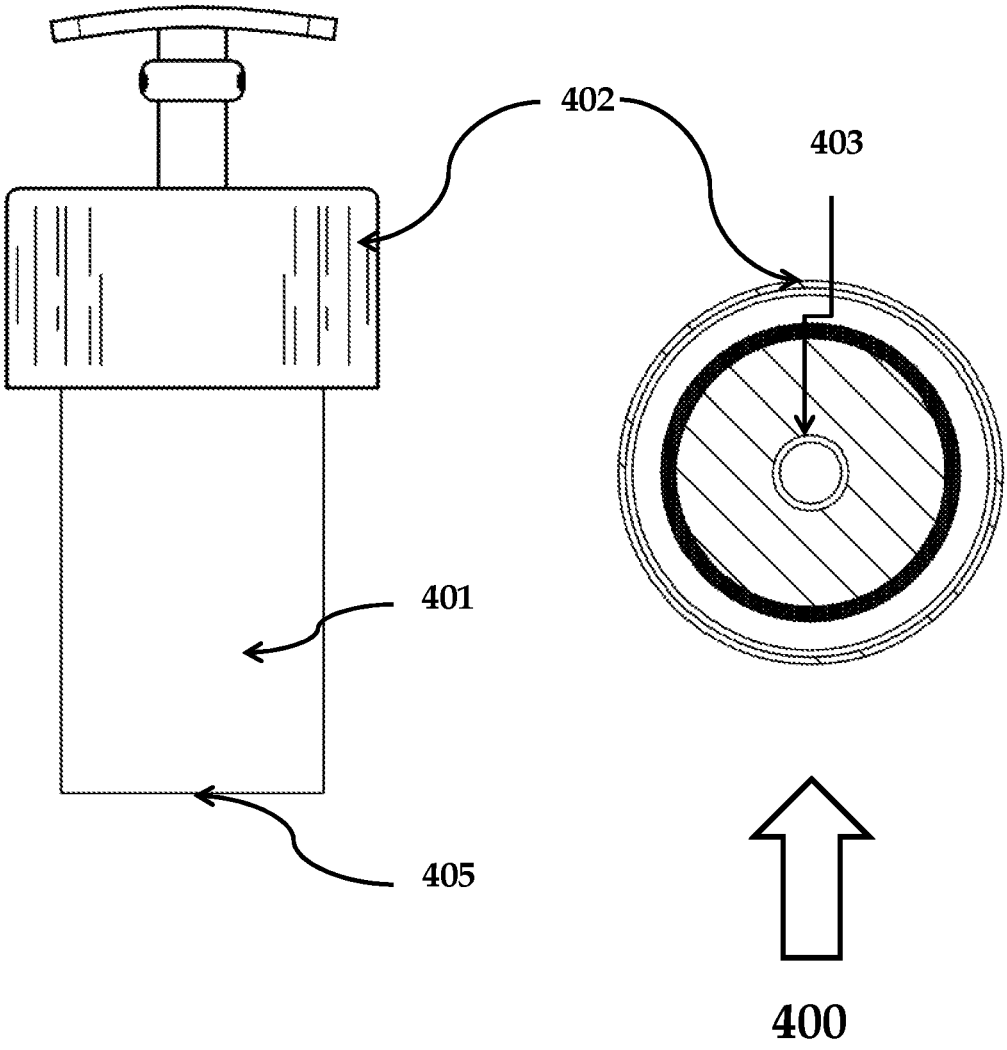
FIG. 5: shows a front view and a top view of the storage receptacle in accordance with the illustrative embodiment.

Referring to FIG. 5 a front view and a top view of the storage receptacle in accordance with the illustrative embodiment of the present disclosure is shown. The storage receptacle (400) comprises a cylindrical housing (401); a hollow knob (402) enclosing the upper section of said housing (401), a hollow channel (403) therewithin the cylindrical housing (401) and a chamber (404) not shown beneath the hollow channel (403) demarcated by a sheath (may be metal, plastic, rigid, semi rigid material) (405).

In the illustrative embodiment of the present disclosure the spray bottle assembly (100) is packaged with a formulation, wherein the storage receptacle (400) stores the active constituent of said formulation selected from a group consisting of pesticides, herbicides, other crop protectants, fertilizers, crop nutrients of chemical or biological/natural origin, biopesticides, bioherbicides, biofertilizers, cleaning composition or other active products to be mixed and dispensed into the reservoir (302) containing the passive constituent such as water, solvent, diluent, carrier or any other form of passive material etc. to create a spray mixture.

Referring back to FIG. 4 the sheath (405) facilitates release of the active constituent when the rectangular head (502) of the dispensing means (500) is pressed. The dispensing means (500) moving through the hollow channel (403) of the storage receptacle (400) released the active constituent accommodated in the chamber (404). The active constituent is released into the reservoir (302). Thus the active constituent thus combines with other passive constituent present in the reservoir (302) to form a mixture having desired concentration for spray/delivery. Therefore, the shelf life of the formulation can be significantly extended ensuring greater bio efficacy of the formulation.

A method aspect directed to a method of making a spray bottle assembly (100) is described in reference to FIGS. 1,2,3,4 and 5. The method for making a spray bottle assembly (100) includes providing a means for discharging constituents of a formulation stored in the spray bottle assembly (100), wherein said means for discharging the constituents may be a spray head (200) as described earlier in the specification; forming a container bottle (300) to be coupled with the spray head (200), said container bottle (300) stores a passive constituent of the formulation, forming a storage receptacle (400) to be coupled with the container bottle (300) such that a distal end of the storage receptacle (400) opens into the container bottle (300), said receptacle (400) stores an active constituent of the formulation (200) isolated from the passive constituent, thereby preventing premixing of the active and the passive constituents of the formulation stored in the spray bottle assembly, and providing a dispensing means (500) to be integrated with the storage receptacle (400).

The step of forming the container bottle further comprises providing a neck portion (301), wherein a topside (1) of the neck portion (301) couples with the means for discharging constituents of the formulation of the spray bottle assembly (100), forming a reservoir (302) extending from an underside (2) of the neck portion (301), said reservoir (302) facilitates storage of the passive constituents of the formulation such as water or other diluents, and providing a means for attaching the storage receptacle (400) on the exterior surface of the reservoir (302). The means for attaching the storage receptacle may be a cavity (303), and said cavity (303) extending from the exterior surface of the reservoir (302) and facilitates coupling of the storage receptacle (400) with the container bottle (300).

The step of forming the storage receptacle (400) may include: providing a housing (401), providing a means for coupling the storage receptacle with the cavity (303) of the container bottle (300), providing a hollow channel (403) within the housing (401) for inserting the dispensing means (500), and providing a chamber (404) beneath the hollow channel (403), wherein said chamber (404) opens into the container bottle (300). The chamber (404) beneath the hollow channel (403) is demarcated by a thin sheath (405) of metal, plastic or any suitable material.

The step of integrating the dispensing means (500) with the storage receptacle (400) includes inserting the dispensing means (500) into the hollow channel (403) of the storage receptacle (400), and said dispensing means (500) dispenses active constituents into the storage reservoir (302) to facilitate mixing of active and passive constituents. The dispensing means may be provided with a locking mechanism (503) to prevent accidental mixing of the active and the passive constituents of the formulation stored in the spray bottle assembly (100).

The container bottle (300) may be of any geometric or non-geometric shape and may be fabricated from any suitable material selected from a group consisting of polymeric materials such as thermoplastics, rubber, thermosets; glass; metals or any other suitable material.

The storage receptacle (400) may be of any geometric or non-geometric shape and may be fabricated from any suitable material selected from a group consisting of polymeric materials such as thermoplastics, rubber, thermosets; glass; metals or any other suitable material.

The spray bottle assembly (100) can be of any size and can be fabricated in any geometric and non-geometric shape such as cylindrical, rectangular, pyramidal etc. from any suitable material selected from a group consisting of polymeric materials such as thermoplastics, rubber, thermosets; glass; metals or any other suitable material to accommodate constituents of the formulation.

Accordingly, by non-limiting examples, an object of the present disclosure includes providing a spray bottle assembly that addresses the problems of the prior art. Another object of the present disclosure includes providing a spray bottle assembly which prevents the premixing of the contents of the bottle during packaging so as to increase shelf life of active contents stored therein.

Another object of the present disclosure includes improving quality of packaging by providing easy to operate actuator that further facilitates mixing of contents of the bottle at the time of use by a user.

Yet another object of the present disclosure includes providing a spray bottle assembly with a comfortable grip for improved handling during actual use in fields. Yet another object of the present disclosure includes providing a locking mechanism to prevent any kind of accidental dispensing and mixing of the contents during transit.

Yet another object of the present disclosure wherein active material may be selected from a group consisting of pesticides, herbicides, other crop protectants, fertilizers, crop nutrients of chemical or biological/natural origin, biopesticides, bioherbicides, biofertilizers, cleaning composition etc. and passive material may be selected from a group comprising water, solvent, diluent, carrier or any other form of passive material etc.

Although the present disclosure described certain embodiments in detail for the purpose of illustration, it is to be understood that such detail is solely for that purpose and that variations can be made therein by those skilled in the art without departing from the spirit and scope of the disclosure except as it may be described by the following claims.

We claim:

1. A spray bottle assembly (100) for packaging and mixing of active and passive constituents of a formulation, comprising:

a means for discharging (200) the formulation;

a container bottle (300) for storing the passive constituents;

a storage receptacle (400) permanently fixed with the container bottle (300), wherein said receptacle (400) comprising:

a housing (401);

a hollow knob (402) enclosing at least some portion of the housing (401) from upper side, wherein the hollow knob (402) couples with the container bottle (300);

a hollow channel (403) within the housing (401); and a chamber (404) beneath the hollow channel (403) demarcated by a thin sheath (405) of metal, plastic or any suitable material, wherein the chamber (404) stores the active constituents in form of a capsule, gel, pouch, other form of encapsulated packaging of packaged product, a dispensing means (500) inserted in the hollow channel (403) of the storage receptacle (400) for facilitating introduction of the active constituents in the container bottle (300) for mixing with the passive constituents to form the formulation for first use, wherein said dispensing means (500) comprises a hollow cylinder housing (501);

a rectangular head (502) at top side of said hollow cylinder housing (501) requiring the action of push to release said active constituents;

a locking mechanism (503); and a detachable protrusion (504)

wherein the locking mechanism (503) prevents accidental mixing of the active and passive constituents before the first use by locking said dispensing means (500) in a fixed position in the storage receptacle (400).

2. The spray bottle assembly (100) of claim 1, wherein the means for discharging (200) includes a spray nozzle (202), a trigger mechanism and a tube (205) to draw the formulation up to the spray nozzle (202) for discharging.

3. The spray bottle assembly (100) of claim 1, wherein the container bottle (300) comprises:

a neck portion (301) wherein a topside (1) of the neck portion (301) comprises a flange (5) extending vertically upwards to a suitable height, said flange (5) facilitating coupling of the means for discharging (200) with the container bottle (300);

a storage reservoir (302) extending from an underside (2) of the neck portion (301), wherein said storage reservoir (302) facilitates storage of the passive constituents; and a cavity (303) on an exterior surface of the storage reservoir (302) adjacent to the neck portion (301), wherein said cavity (303) extends vertically upwards from the exterior surface of the storage reservoir (302) and facilitates coupling of the hollow knob (402) of the storage receptacle (400) with the container bottle (300).

4. The spray bottle assembly (100) of claim 1, wherein the container bottle (300) may be suitable to accommodate liquids, powders, particulates, solids, gases, and other like substances.

5. The spray bottle assembly of claim 1, wherein the locking mechanism comprises an outgrowth on an outer surface of the hollow cylindrical housing.

* * * * *